US006310549B1

(12) United States Patent
Loftin et al.

(10) Patent No.: US 6,310,549 B1
(45) Date of Patent: Oct. 30, 2001

(54) WIRELESS SECURITY SYSTEM

(75) Inventors: Jon Loftin, Arden; Richard Crane, Asheville, both of NC (US); Jerry Crane, Anderson, SC (US)

(73) Assignee: Digitech International, Asheville, NC (US)

( * ) Notice: Subject to any disclaimer, the term of this patent is extended or adjusted under 35 U.S.C. 154(b) by 0 days.

(21) Appl. No.: 09/651,537

(22) Filed: Aug. 29, 2000

(51) Int. Cl.[7] ..... G08B 13/08

(52) U.S. Cl. ..... 340/547; 324/207.21; 340/539; 340/545.1

(58) Field of Search ..... 340/545.1, 545.6, 340/545.9, 547, 551, 539, 693.9, 568.1, 571, 689; 324/207.13, 207.21, 207.22; 200/61.62, 61.45 R, 61.52

(56) References Cited

U.S. PATENT DOCUMENTS

| | | | | |
|---|---|---|---|---|
| 3,719,875 | | 3/1973 | Holland et al. | 318/254 |
| 3,745,553 | * | 7/1973 | Kardashian | 340/547 X |
| 4,079,360 | | 3/1978 | Ookubo et al. | 365/158 |
| 4,176,305 | | 11/1979 | Cuno | 318/653 |
| 4,262,335 | | 4/1981 | Ahlen et al. | 701/51 |
| 4,354,652 | * | 10/1982 | Zegarski et al. | 248/201 |
| 4,359,646 | * | 11/1982 | Mejia et al. | 340/547 X |
| 4,691,195 | * | 9/1987 | Singelman et al. | 340/545.4 |
| 4,706,073 | | 11/1987 | Vila Masot | 340/639 |
| 4,835,520 | * | 5/1989 | Aiello | 340/545.6 |
| 4,910,497 | * | 3/1990 | Seachris | 340/545.2 |
| 5,341,097 | | 8/1994 | Wu | 324/207.2 |
| 5,748,083 | * | 5/1998 | Rietkerk | 340/568.2 |
| 5,877,686 | * | 3/1999 | Ibey et al. | 340/571 |
| 6,043,752 | | 3/2000 | Hisada et al. | 340/5.26 |
| 6,049,875 | | 4/2000 | Suzuki et al. | 713/200 |
| 6,104,288 | * | 8/2000 | Hopkins | 340/545.1 |

* cited by examiner

*Primary Examiner*—Thomas Mullen
(74) *Attorney, Agent, or Firm*—Michael A Mann; Nexsen Pruet Jacobs & Pollard LLC

(57) ABSTRACT

The present invention is a wireless security system. Each alarm sensor contains three magnetoresistive sensors and that are capable of detecting the three-dimensional vector of a magnetic field. Preferably, the sensors detect the orientation of the door or window based upon the earth's magnetic pole. The three-dimensional vector output of the magnetoresistive sensors is received by a microprocessor on-board the alarm sensor. The microprocessor continuously compares the magnetoresistive sensors output with the maximum allowable position of the door or window. If the magnetoresistive sensors output exceeds the maximum allowable position, the microprocessor will signal an alarm, which is transmitted to the network controller via a transmitter on-board the alarm sensor. If an intruder attempts to disable or override a sensor, the alarm sensor will transmit a tamper signal to the network controller.

19 Claims, 1 Drawing Sheet

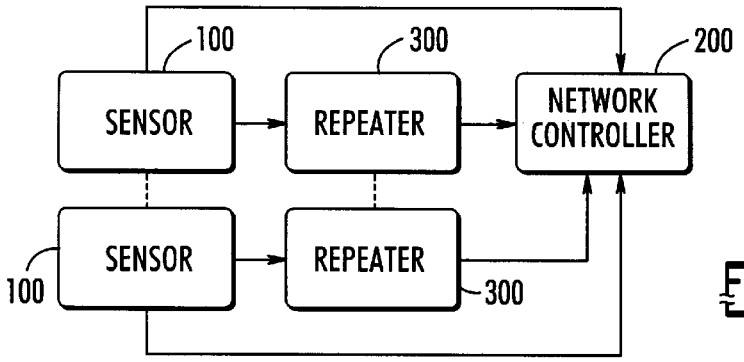
FIG. 1
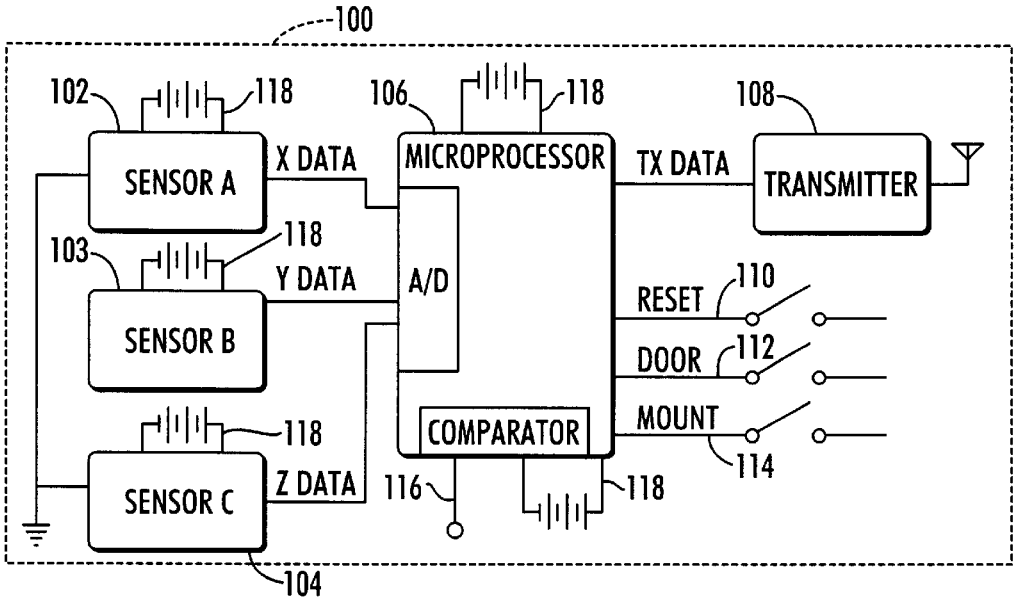
FIG. 2
FIG. 3
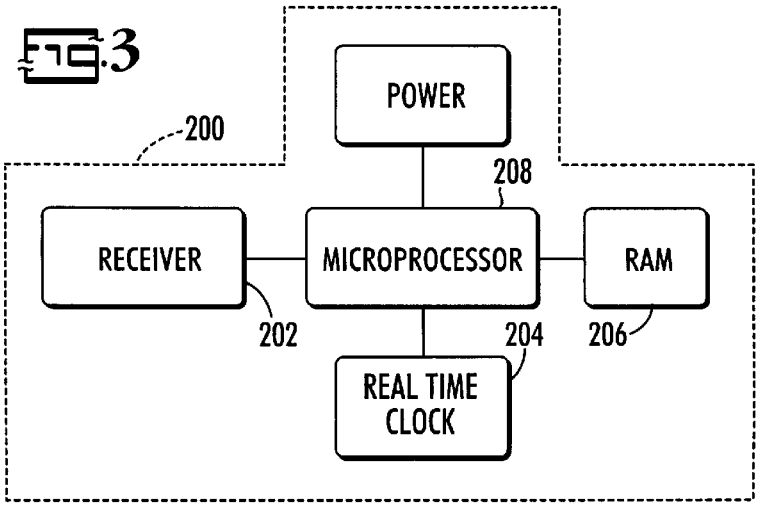

WIRELESS SECURITY SYSTEM

FIELD OF THE INVENTION

The present invention relates generally to electronic security systems and in particular to wireless security systems.

BACKGROUND OF THE INVENTION

In the U.S., a burglary currently occurs every 13 seconds. Accordingly, security systems have gained popularity for home owners and businesses alike. For businesses that lease spaces, a security system is a necessity to compete in the marketplace. Whether it be the lease of apartments, office space, industrial space or self-storage facilities, the ability to attract new customers is greatly dependent upon a reliable security system to protect the tenants' valuable assets.

For self-storage facilities a reliable security system is important, not only to attract new tenants, but also to retain existing tenants. The term self storage facility describes a plurality of freestanding buildings with a plurality of separate, individual storage units that are typically rented on a monthly basis. In many of these facilities, tenants are responsible for the security of their units. Accordingly, the tenant will put a pad lock on the door to the unit to prevent theft. Unfortunately, the padlock can be easily defeated by simply using a bolt cutter to remove the padlock and gain access to the contents of the unit.

Electronic door alarms are also used in some self-storage facilities. Typically, these individual door alarms are hardwired devices that use a magnetic switch mounted to the floor or wall next to the door and a magnet mounted on the moving portion of the door. When the door is opened the magnet moves away from the switch, causing the switch to open the circuit, thereby signaling the opening of the unit door.

There is a trend toward offering these door alarms in new self-storage facilities. Self-storage facilities that have individual unit door alarms can normally attract a higher number of tenants and charge a higher rent per square foot than those facilities without the alarms. As a result, there is pressure on the owners of existing units to update security in order to retain existing tenants and attract new tenants.

Retrofitting an existing self storage unit with individual door alarms, however, is a difficult task. A hardwired security system is not a viable option, due to logistical problems and overwhelming expense. Typically, magnetic contacts are mounted inside the unit to protect from being defeated by a thief. If the magnetic contacts are mounted inside the unit, however, there is the need to access a tenant's space to install the system. Since the tenant typically puts a padlock on the unit, it is impossible for the owner of the facility to access the individual units without getting permission and cooperation from each tenant. As a result, this type of system is difficult to implement.

If the magnetic contacts were placed on the outside of each unit, in order to avoid accessing all the individual units, there are obvious security concerns. Placing the magnet contacts outside the unit gives a thief access to both the magnet and magnetic switch. Since standard magnets and biased magnets can be easily defeated, the owner of the facility would be forced to use a high-security magnet. Unfortunately, the cost of these high-security magnets dramatically increases the total cost of the system. The cost of using a high-security magnet, along with the costs of wiring, conduit and installation, prevents hardwired systems from being a cost-effective option for retrofitting existing self-storage facilities with security systems.

In order to lower the costs of wiring an existing unit, wireless security systems have been proposed. The wireless security systems work in a similar manner to that of magnetic contact systems. If the magnet moves away from the switch the system will transmit an RF alarm signal to a remote station.

Unfortunately, wireless systems do not work within either new or existing self-storage units, due to the typical metal construction of the units. As a result of the metal construction, the wireless detectors cannot transmit outside the unit to a remote station in a reliable manner. Moreover, the installation of the magnetic contacts, as with the hardwired systems, requires access to all the individual units.

Therefore, there is a need for a reliable security system that can be easily installed in either new or existing self-storage facilities in a cost-effective manner.

SUMMARY OF THE INVENTION

According to its major aspects and briefly described, the present invention is a wireless security system. Although the system will be described with respect to its application in self-storage facilities, it is clear that the system could be used anywhere a security system is used. Each unit in the facility is preferably equipped with an alarm sensor that is mounted outside the unit on the door or window that allows access to the unit. The alarm sensor continuously detects the position of the door or window with which it is associated. If the door's or window's position is changed, the alarm sensor transmits an alarm signal to the network controller. If an intruder attempts to disable or override an alarm sensor, the alarm sensor will transmit a tamper signal to the network controller.

Each alarm sensor contains three magnetoresistive sensors that are capable of detecting the three-dimensional vector (magnitude and phase) of a magnetic field. Preferably, the magnetoresistive sensors detect the orientation of the door or window based upon the earth's magnetic pole. As a result, a separate magnet is not required and the alarm sensor can detect movement of a door, regardless of whether the door opens about the vertical or horizontal plane. The three-dimensional vector output of the magnetoresistive sensors is received by a microprocessor on-board the alarm sensor. The microprocessor continuously compares the magnetoresistive sensors output with the maximum allowable position of the door or window. If the magnetoresistive sensors' output exceeds the maximum allowable position, the microprocessor will signal an alarm, which is transmitted to the network controller via a transmitter on-board the alarm sensor.

A major advantage of the present invention is that the landlord need not gain access to a tenant's space in order to install the security system. A major feature of the present invention, installation of the sensors on the outside of the door or window, is the key to eliminating the need to access the tenant's space. In self-storage facilities, for example, where the tenant can prevent landlord access, the logistics of obtaining access to each unit for installation is virtually impossible. Accordingly, this feature eliminates the logistical problems with retrofitting an existing unit.

The position of an alarm sensor outside the door or window is a major feature of the present invention. With the alarm sensor outside the unit there is no signal attenuation so a wireless system can be used. As a result of using a wireless system, installation costs are substantially reduced, thereby allowing security systems to be installed cost effectively in existing units.

Another advantage of the present invention is the elimination of the need for a separate magnet and magnetic switch. In the present invention, the alarm sensor uses magnetoresistive sensors to prevent the need for an external magnet. Since the magnetoresistive sensors detect the position of the door or window based upon the earth's magnetic pole, the use of an external magnet, which could be easily defeated, is not necessary.

These and other features and their advantages will be apparent to those skilled in the art from a careful reading of the Detailed Description of Preferred Embodiments, accompanied by the following drawings.

BRIEF DESCRIPTION OF THE DRAWINGS

In the drawings,

FIG. 1 is a schematic overview of a security system, according to a preferred embodiment of the present invention;

FIG. 2 is a detailed schematic of an alarm sensor, according to a preferred embodiment of the present invention; and FIG. 3 is a detailed schematic of a network controller, according to a preferred embodiment of the present invention.

DETAILED DESCRIPTION OF PREFERRED EMBODIMENTS

The present invention is a wireless security system. Although the system will be described with respect to its application in self-storage facilities, it is clear that the system could be used anywhere a security system is used. For example, security system could be used to secure any building, bank safe or any other space. Each unit in the facility is preferably equipped with an alarm sensor 100 that is mounted outside the unit on the door or window that allows access to the unit. Each alarm sensor 100 continuously detects the position of an associated door or window that allows entry to a unit. In the event that the position of the door or window exceeds a predetermined position, alarm sensor 100 will transmit an alarm signal to a central network controller 200. If an intruder attempts to disable or override a sensor, the alarm sensor 100 will transmit a tamper signal to the network controller 200.

Referring to FIG. 1, there is shown a schematic overview of the security system. The security system has three main components: at least one alarm sensor 100 that transmits an alarm signal or tamper signal to a central network controller 200, depending upon the circumstances, an optional repeater 300 that extends the distance of the sensor transmissions and a network controller 200 that manages the information received by alarm sensors 100.

Each unit in the facility preferably has an alarm sensor 100 that detects the position of a door or window that allows entry to the unit. Each alarm sensor 100 is mounted outside of the unit at a location on the unit wherein the typical metal construction of the unit will not attenuate the signal transmitted from alarm sensor 100 to network controller 200. Due to the position of alarm sensor 100 outside the unit, alarm sensor 100 is equipped with tamper switches 112 and 114 to prevent a thief from overriding alarm sensor 100, as discussed below.

Referring to FIG. 2, there is shown a schematic view of an alarm sensor 100 according to a preferred embodiment of the present invention. Although all components in alarm sensor 100 are preferably battery powered 118, it is clear that other sources of power could be used. Alarm sensor 100 contains three magnetoresistive sensors 102, 103 and 104 that are capable of detecting the magnitude and phase of the three-dimensional vector produced by a magnetic field. Preferably, the magnetoresistive sensors 102, 103 and 104 detect the orientation of the door or window based upon the earth's magnetic pole. As a result, a separate magnet is not required. In the event that there is high ambient magnetic noise, an auxiliary magnet could be located near the sensor. Preferably, magnetoresistive sensors sold under the trademark Honeywell HMC 1021 and HMC1022 are used.

The three-dimensional vector output of magnetoresistive sensors 102, 103 and 104 is received by a microprocessor 106. Microprocessor 106 continuously compares the magnetoresistive sensors' outputs with the maximum allowable position of the door or window. If the magnetoresistive sensors' outputs indicate that the door's or window's maximum allowable position has been exceeded, microprocessor 106 will signal an alarm, which is transmitted to network controller 200 via transmitter 108. In order to continuously monitor the status of sensor 100, microprocessor 106 sends a message periodically via transmitter 108 with the current status of sensor 100. By using the magnetoresistive sensors 102, 103 and 104 in this manner, alarm sensor 100 is able to detect if a door or window has been opened, regardless of whether the door or window opens vertically or horizontally. Preferably, a microprocessor sold under the trademark Atmel AT90LS2333 is used.

Prior to using alarm sensor 100, the initial "closed" position of the door must be programmed using a reset switch 110. Reset switch 110 is a magnetic reed relay that allow s alarm sensor 100 to be initialized whenever alarm sensor 100 is first mounted. To install alarm sensor 100, alarm sensor 100 should be mounted to the outside of unit, on the door or window that provides entry to the unit. With the door or window in the closed position, the installer will force alarm sensor 100 to reset by using an external magnet. After removing the external magnet from alarm sensor 100, alarm sensor 100 will calibrate for a closed position reading for a period of time. In order to prevent alarm sensor 100 from being defeated by a thief, resetting alarm sensor 100 in this manner will result in microprocessor 106 sending an alarm signal to network controller 200 via transmitter 108.

Alarm sensor 100 has two tamper switches that prevent alarm sensor 100 from being disabled: a mount tamper switch 114 signals if the sensor is removed from the door or window and a battery door tamper switch 112 signals if the power supply 118 is removed. Both tamper switches 112 and 114 are preferably opto-electronic sensors. Mount tamper switch 114 senses the presence of a flag that is attached to the mounting plate for alarm sensor 100. If alarm sensor 100 is removed from the door or window, the flag will be removed from alarm sensor 100 by the mechanical movement of alarm sensor 100 being moved. Battery door tamper switch 112 senses the presence of the battery door. If the battery door is removed, battery door tamper switch 112 will signal that the battery door has been removed.

Alarm sensor 100 detects low battery power by having microprocessor 106 compare a portion of battery voltage 118 with a reference voltage 116. When a threshold battery voltage is crossed, microprocessor 106 will signal a "LOW BATTERY" message to network controller 200 via transmitter 108.

Alarm sensor 100 sends all signals to network controller 200 using a transmitter 108. Although numerous RF transmitters could be used to transmit signals to network controller 200, preferably a transmitter sold under the trademark RF Monolithics HX-2000 is used. The transmissions preferably arc at 900 MHz at a rate of 2400 baud and with 8 to 12 bit encoding. Transmitter 108 will use an antenna preferably with a gain of −8 to −12 dB. It will be clear to one of ordinary skill in the art many different transmission rates, frequencies and encoding techniques could be used.

Referring again to FIG. 1, optional repeaters 300 receive the information transmitted by alarm sensors 100 and retransmit the information to network controller 200. Repeaters 300 simply extend the distance that alarm sensors 100 are able to transmit. In the event that the distance between alarm sensors 100 and network controller 200 is not significant, the use of repeaters 300 is not necessary. It will be clear to one of ordinary skill in the art whether the use of repeaters is necessary to extend the distance that sensors' transmission can be transmitted.

Network controller 200 manages and logs the information received from all alarm sensors 100. Referring to FIG. 3, there is shown a detailed schematic view of a network controller 200, according to a preferred embodiment of the present invention. Network controller 200 has a receiver 202 to receive the information transmitted from alarm sensors 100 or repeaters 300. All data received by receiver 202 is transmitted to a microprocessor 208. Microprocessor 208 records all events received on system memory 206, including the time that all data is received using a real time clock 204. In the event of an alarm, network controller 200 checks to see if the tenant of the associated unit is on-site. If the tenant is on-site, no alarm will be sounded. Otherwise, however, network controller 200 will be capable of communicating with an offsite security agent, using cellular, radio or wire communications.

In use, alarm sensor 100 is mounted outside each door on each unit in a facility. In order to program alarm sensor 100 with the "closed" position of the door, an external magnet is placed over alarm sensor 100. As a result, alarm sensor 100 will calibrate the three-dimensional vector in the closed position, using the earth's magnetic pole as a reference. If the door is moved to a position that exceeds the threshold position, alarm sensor 100 will transmit an alarm signal to network controller 200. If a thief attempts to remove or override alarm sensor 100, a tamper signal is transmitted to network controller 200. In addition, when the battery 118 that powers alarm sensor 100 runs low on power, a low battery signal is transmitted to network controller 200. Network controller 200 manages and logs the information received from alarm sensors 100.

It will be apparent to those skilled in the art that many substitutions and modifications may be made to the preferred embodiments just described without departing from the spirit and scope of the present invention, defined by the appended claim.

What is claimed is:

1. An alarm sensor comprising:

a housing;

detecting means carried by said housing for detecting movement of said housing, wherein said detecting means comprises means for detecting changes in the position of said housing relative to the three-dimensional vector of a magnetic field; and alarm means in electrical connection with said detecting means and carried by said housing for signaling when said detecting means detects movement of said housing.

2. The alarm sensor as recited in claim 1, wherein said housing is capable of being mounted to the exterior portion of a door.

3. The alarm sensor as recited in claim 2, further comprising tamper means for detecting the presence of an external magnetic field in proximity to said housing.

4. The alarm sensor as recited in claim 1, wherein said detecting means comprises means for detecting changes in position of said housing relative to the three-dimensional vector of the earth's magnetic field.

5. The alarm sensor as recited in claim 1, wherein said detecting means comprises at least two magnetoresistive sensors.

6. The alarm sensor as recited in claim 1, wherein said housing is mounted to a surface, and wherein said alarm sensor further comprises tamper means for detecting the detachment of said housing from the surface.

7. The alarm sensor as recited in claim 1, wherein said alarm means further comprises means for signaling using RF communications.

8. The alarm sensor as recited in claim 1, wherein said housing is capable of being mounted to a window.

9. An alarm sensor comprising:

a housing;

detecting means carried by said housing for detecting changes in the position of said housing relative to the three-dimensional vector of the earth's magnetic field; and alarm means in electrical connection with said detecting means and carried by said housing for signaling when said detecting means detects movement of said housing.

10. The alarm sensor as recited in claim 9, wherein said detecting means comprises at least two magnetoresistive sensors.

11. The alarm sensor as recited in claim 10, further comprising tamper means for detecting the presence of an external magnetic field in proximity to said housing.

12. The alarm sensor as recited in claim 10, wherein said housing is mounted to a surface, and wherein said alarm sensor further comprises tamper means for detecting the detachment of said housing from the surface.

13. The alarm sensor as recited in claim 10, wherein alarm means further comprises means for signaling using RF communications.

14. The alarm sensor as recited in claim 10, wherein said housing is capable of being mounted to the exterior portion of a door.

15. The alarm sensor as recited in claim 10, wherein said housing is capable of being mounted to a window.

16. A security system comprising:

at least one alarm sensor having a housing, at least two magnetoresistive sensors carried by said housing, said at least two magnetoresistive sensors capable of detecting the three-dimensional vector of a magnetic field;

comparator means carried by said housing and in electrical connection with said at least two magnetoresistive sensors, said comparator means capable of determining changes in the detections of said at least two magnetoresistive sensors;

alarm means in electrical connection with said at least two magnetoresistive sensors and carried by said housing for signaling when said comparator means determines changes in the detections of said at least two magnetoresistive sensors; and a network controller capable of receiving signals from each said alarm means of said at least one alarm sensor.

17. The security system as recited in claim 16, further comprising tamper means for detecting the presence of an external magnetic field in proximity to said housing.

18. The security system as recited in claim 16, further comprising tamper means for detecting the detachment of said housing from a surface in which said housing is mounted.

19. The security system as recited in claim 16, wherein said housing of said at least one sensor is capable of being mounted to the exterior portion of a door.

* * * * *

UNITED STATES PATENT AND TRADEMARK OFFICE

CERTIFICATE OF CORRECTION

PATENT NO. : 6,310,549 B1
DATED : October 30, 2001
INVENTOR(S) : Loftin et al.

It is certified that error appears in the above-identified patent and that said Letters Patent is hereby corrected as shown below:

Title page,
Item [75], Inventors, -- Jon Loftin, Arden; Richard Ford, Asheville --

Signed and Sealed this

Sixth Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,310,549 B1
DATED : October 30, 2001
INVENTOR(S) : Loftin et al.

It is certified that error appears in the above-identified patent and that said Letters Patent is hereby corrected as shown below:

Title page,
Item [75], should read: -- Inventors: Jon Loftin, Arden; Richard Crane, Asheville, both of NC (US); Jerry Crane, Anderson, SC (US) --

Signed and Sealed this

First Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,310,549 B1
DATED : October 30, 2001
INVENTOR(S) : Loftin et al.

It is certified that error appears in the above-identified patent and that said Letters Patent is hereby corrected as shown below:

Title page,
Item [75], should read: -- Inventors: Jon Loftin, Arden; Richard Ford, Asheville, both of NC (US); Jerry Crane, Anderson, SC (US) --.

This certificate supersedes Certificate of Corrections issued August 6, 2002 and April 1, 2003.

Signed and Sealed this

First Day of November, 2005

JON W. DUDAS
*Director of the United States Patent and Trademark Office*